US005223668A

United States Patent [19]

Takaya et al.

[11] Patent Number: 5,223,668

[45] Date of Patent: Jun. 29, 1993

[54] SINGLE COMPONENT DEVELOPING DEVICE WITH VELOCITY OF ROLLER DEPENDENT ON TIME CONSTANT OF CIRCUIT FORMED BY RESISTOR LAYER OF DEVELOPER CARRYING MEMBER AND PHOTOSENSITIVE DRUM

[75] Inventors: Toshihiko Takaya, Matsudo; Kouji Sakamoto, Tokyo; Toshihiro Sugiyama; Naomi Fukagawa, both of Yokohama, all of Japan

[73] Assignee: Ricoh Company, Ltd., Tokyo, Japan

[21] Appl. No.: 515,876

[22] Filed: Apr. 27, 1990

[30] Foreign Application Priority Data

| | | | |
|---|---|---|---|
| Apr. 27, 1989 | [JP] | Japan | 1-108450 |
| Apr. 27, 1989 | [JP] | Japan | 1-108451 |
| Apr. 27, 1989 | [JP] | Japan | 1-108452 |
| Jan. 24, 1990 | [JP] | Japan | 2-14322 |

[51] Int. Cl.[5] ..... G03G 15/06

[52] U.S. Cl. ..... 118/651; 355/259

[58] Field of Search ..... 355/251, 253, 259, 245; 118/656, 657, 658, 653, 651, 661

[56] References Cited

U.S. PATENT DOCUMENTS

| | | | |
|---|---|---|---|
| 4,194,828 | 3/1980 | Hölz et al. | 118/651 X |
| 4,827,868 | 5/1989 | Tarumi et al. | 118/653 |
| 4,899,689 | 2/1990 | Takeda et al. | 118/651 |
| 4,930,438 | 6/1990 | Demizu et al. | 118/651 |

*Primary Examiner*—A. T. Grimley
*Assistant Examiner*—Christopher Horgan
*Attorney, Agent, or Firm*—Oblon, Spivak, McClelland, Maier & Neustadt

[57] ABSTRACT

A developing device of one-component developing type for use in the electrophotographic copying machine capable of developing latent image on the image carrier. The device comprises a developer carrying member having resistor layer on its surface layer, a regulation member for regulating the thickness of developer disposed on the developer carrying member, a replenishing member for replenishing developer onto the developer carrying member after finishing a process of developing, and a removing member for removing developer remaining on the developer carrying member after finishing a process of developing. The device sets the relationship of the time constants and the operational time periods in the form of inequalities, in order to obtain an optimum condition of developing. There are nine methods of setting the combination of time constant(s) and the operational time periods so as to satisfy the respective inequalities mentioned in the description of the invention.

10 Claims, 2 Drawing Sheets

SINGLE COMPONENT DEVELOPING DEVICE WITH VELOCITY OF ROLLER DEPENDENT ON TIME CONSTANT OF CIRCUIT FORMED BY RESISTOR LAYER OF DEVELOPER CARRYING MEMBER AND PHOTOSENSITIVE DRUM

BACKGROUND OF THE INVENTION

1. Field of the Invention

The present invention relates to a developing device for the electrophotographic copying machine by use of one-component developer.

2. Description of the Prior Art

Generally, there exists a one-component developer type not employing a mixture of carrier, particles and toner particles and instead employing only toner without carrier in addition to a two-components developer type employing both of them, as to the developing system.

In a developing device employing one-component toner of high inherent resistance value per volume, as it is called, where the resistance value is higher than the medium, there is an improved developer carrying member (developing roller) which performs the actual development in opposition to the photosensitive body. This is to improve the image quality such as halftone, sharpness, etc..

For instance, according to the Laid-open Japanese Patent Publication No. 55-46768, a resistor layer is formed on the surface of the electrically conductive supporter layer of the developing roller. The above-mentioned laid-open patent provides a developing device having a resistance ratio value of the resistor layer in the range of $10^8$ to $10^{15}$ Ω/cm, in which the intensity of electric field is controlled in the developing area. Namely, it is desirable to use a conductive developing roller to perform bias developing by use of the developing roller. However, in such construction, an edge effect cannot be exhibited. On the contrary, in the case of using a completely insulated developing roller, a bias effect cannot be exhibited and thereby background dirt may be present. Therefore, the resistance value of the resistor layer has to be raised within the area that has the developing bias applied thereto on the developing roller.

Further, the Laid-open Japanese Patent Publication No. 57-66456 proposes an electric current supplying device, in which a medium-resistance-value resistor layer is formed on the high-resistance-value resistor layer of the developing roller, and thereby the developing electric current is supplied to the developing roller through the high-resistance-value layer and thereafter through the medium-resistance-value layer. Namely, in the above-mentioned laid-open patent, it is the main (primary) object to optimize the intensity of the developing electric field by suitably setting the resistance ratio and the thickness of the material employed for the resistor layer, and further, the self-bias effect of the medium-resistance-value resistor layer is utilized in the developing area.

In case that, by utilization of the prior-art technology, only high-resistance-value resistor layer is used on the surface layer of the developer carrying member in order to obtain an edge effect at the time of developing, and further, the thickness of the toner layer on the developing roller is regulated to a desired value by use of a regulation member for regulating the thickness of the developer disposed on the developer carrying member before entering the developing area, the following problems may occur.

Namely, there exists an opposing electric charge counterbalanced with the toner layer on the surface of the developing roller. Therefore, in general, the developing portion is in a state of excessive opposing electric charge immediately after the thickness regulation member which regulates the thickness of the thin layer which passes therethrough. On such occasion, since the effective bias to be applied to the developing roller in the developing process varies due to the surface electric field caused by the amount of electric charge on the surface of the developing roller, the amount of the effective bias needs to be balanced with that of the electric charge of the developer layer entering the developing area, in order to perform a proper developing operation in the developing area. As to the conventional device, the above-mentioned matter cannot be guaranteed.

Furthermore, regarding the developing roller having high-resistance-value resistor layer as mentioned above, the opposing members such as the photosensitive body and the toner removing roller perform a toner supplying operation in a state of keeping an electric charge after finishing the developing process. Consequently, the toner supply varies sometimes. For instance, the toner layer on the surface of the developing roller has a portion peeled off in the developing process and other portions remain without playing a role in development. These conditions exist in the developing device, so that it causes an unequal electric potential on the developing device. Consequently, the above matter yields a difference in the amount of toner supplied. This causes unevenness in the toner layer and thereby exerts a bad influence on the performance of development.

SUMMARY OF THE INVENTION

In the aforementioned prior art, there have been raised several points at issue regarding the developing device that the change of the developing electric field due to the environmental variation exerts an influence directly upon the image to be formed.

It is a primary object of the present invention to solve the problems of the prior art as described heretofore.

It is another object of the present invention to provide an improved developing device eliminating the defects of the prior art.

It is still another object of the present invention to provide a developing device not affected by the variation of the environmental condition.

It is still another object of the present invention to provide a developing device in which the thickness of the toner layer on the developer carrying member is regulated by the thickness regulation member.

The above-mentioned objects can be attained by practicing the method of the time constants and the time period in the developing portion of the device, described in detail hereinafter.

BRIEF DESCRIPTION OF THE DRAWINGS

A more complete appreciation of the invention and many of the attendant advantages thereof will be readily obtained at the same becomes better understood by reference to the following detailed description when considered in connection with the accompanying drawings, wherein.

DESCRIPTION OF THE INVENTION

Figure 1:
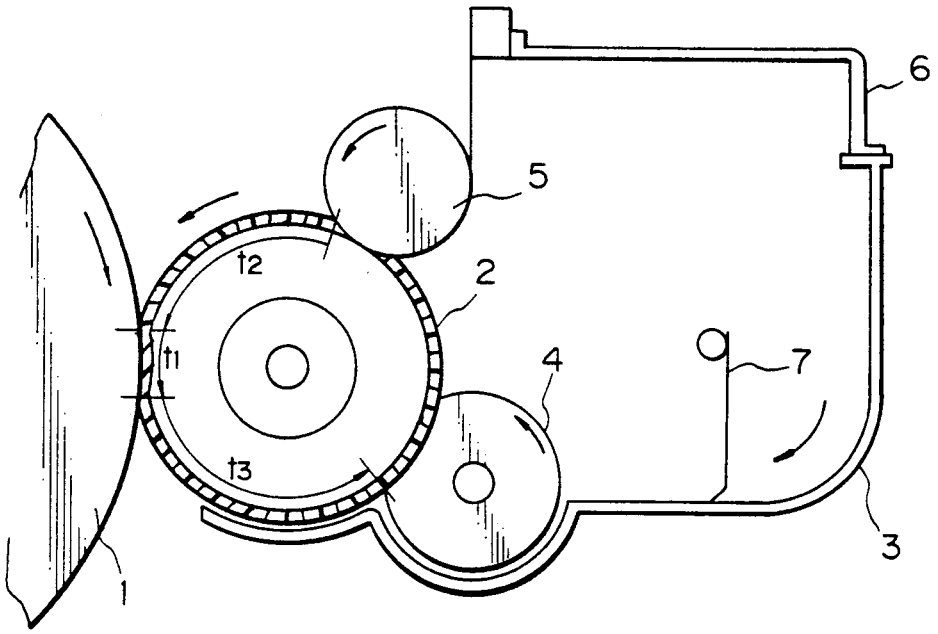
FIG. 1 is an outlined front view showing a first embodiment according to the present invention.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

A developing device of one-component developing type for developing the latent image on image carrier according to the present invention comprises a developer carrying member having resister layer on surface layer thereof, and the same further comprises a removing member for removing developer remaining on the developer carrying member after finishing the process of developing, a developer replenishing member for replenishing developer on the developer carrying member after finishing the process of developing, and a thin layer regulation member for regulating the thickness of developer disposed on the developer carrying member, as occasion demands.

The resistor layer of the developer carrying member has respective characteristics satisfying the equations as set forth below in the respective embodiments of the present invention, wherein, C1 is an electrostatic capacitance of space between photosensitive body and developer layer, R is an electric resistance of the resistor layer, C2 is another electrostatic capacitance of the resistor layer, $\tau_1$ is a time constant determined by the constants; R and C2, in accordance with the following equation:

$$\tau_i = C2 \times R.$$

$\tau_2$ is another time constant determined by the constants; R, C1 and C2, in accordance with the following other equation:

$$\tau_2 = (C1 + C2) \times R.$$

where t1 is a time period during which a point situated on the developer carrying member passes through a developing area determined by the developer carrying member and the photosensitive body, t2 is another time period during which the point situated on the developer carrying member passes through the developing area from the thin layer regulation member till entering the developing area, t3 is still another time period during which the point situated on the developer carrying member passes through the developing area after passing through the developing area till arriving at the developer replenishing member, and t4 is still another time period during which the point situated on the developer carrying member passes through the developing area after passing through the removing member till arriving at the developer replenishing member.

The following exist by way of the characteristics of the developer carrying member's resistor layer, in the respective embodiments:

First embodiment $t1 < \tau_2$
Second embodiment $t2 > \tau_1$
Third embodiment $t3 > \tau_1$
Fourth embodiment $t4 > \tau_1$
Fifth embodiment $t1 < t_2$ and $\tau_2 > \tau_1$
Sixth embodiment $ti < \tau_2$ and $t3 > \tau_1$
Seventh embodiment $t1 < \tau_2 > t_1$, and $t3 > \tau_1$
Eight embodiment $t1 < t_2$ and $t4 > \tau_1$
Ninth embodiment $t1 < \tau_2$, $t2 > \tau_1$, and $t4 > \tau_1$

Function

As shown in the first embodiment, in case that the time constant $\tau_2 = (C1 + C2) \times R$ determined by the resistor layer and the space between the photosensitive body and the developer layer is longer than the time period t1 for the point situated on the developer carrying member to pass through the developing area determined by the developer carrying member and the photosensitive body. It can be presumed that the resistor layer may be an insulator layer in the developing area. Consequently, it follows that the intensity of the developing electric field may become stable in the developing area and thereby a desired developing condition can be obtained. Namely, the resistor layer itself is not used as an insulator layer, and thereby an extra margin is possible in connection with the amount of field necessary for controlling the developing electric field for its variation due to the environmental condition, etc.

Furthermore, the thickness of the developer layer formed on the developer carrying member is regulated so as to become a desired value by the thin layer regulation member, before entering the developing area.

At this time, according to the second embodiment, since the time constant $\tau_1$ of the resistor layer of the developer carrying member is smaller than the time period t2 during which the point situated on the developer carrying member passes through the area from the thin layer regulation member till time in which it enters the developing area, the surplus electric charge on the developer carrying member is sufficiently attenuated until this point enters the developing area.

Consequently, the state of the electric potential on the surface of the developer carrying member may be at a proper level, and thereby it follows that the developing operation can be performed without any variation of the effective bias.

Further, the developer is replenished onto the developer carrying member by the developer replenishing member after finishing the process of developing. At this time, the developer on the surface of the developer carrying member is peeled off from the surface during the process of developing so that a portion without developer and another portion with some remaining developer coexist thereon. Consequently, the electric potential on the surface of the developer carrying member turns out to be in a state of nonuniformity.

Hereupon, according to the third embodiment, since the time constant $\tau_1$ of the resistor layer is smaller than the time period t3 during which the point situated on the developer carrying member passes through the area after passing through the developing area till arriving at the developer replenishing member,, the surplus electric potential on the surface of the developer carrying member is sufficiently attenuated till arriving at the developer replenishing member does not start the operation of replenishing the developer in a state of keeping an electric carrier on the process of developing after finishing the process, and in consequence it may be possible to replenish the developer in a state of keeping uniformity in order not to exert an influence on the effective developing bias.

The situation is also same as in the case of providing the removing member for removing developer remaining on the developer carrying member after finishing the process of developing. As shown in the fourth embodiment since the time constant $\tau_1$ of the resister layer is smaller than the time period t4 during which it takes the point situated on the developer carrying member to pass through the area after passing through the removing member till arriving at the developer replenishing member, it may be possible to replenish the developer in a state of keeping uniformity (in order not to exert an influence on the effective developing bias).

Furthermore, as shown in the fifth through ninth embodiments, a multiple effect can be demonstrated on the condition of suitably combining those embodiments.

DESCRIPTION OF THE PREFERRED EMBODIMENT

The first embodiment of the present invention is described hereinafter, referring to FIG. 1 through FIG. 3.

First of all, in the developing device of the first embodiment, a developing roller 2, employed as the developer carrying member, is installed such that the member is brought into contact with, for instance, a drum-shaped photosensitive body 1 so as to be oppose thereto. A replenishing roller 4, as the member for replenishing the developer, and a thin layer thickness regulating roller 5, as the member for regulating the thickness of the thin layer, are installed around the developing roller 2 in a developer container 3.

On the front side of the replenishing roller 4, an agitator 7 is used for agitating the toner (one-component developer) which is falling down from the side of the toner cartridge 6 by rotating it and supplying to the replenishing roller 4.

Figure 2:
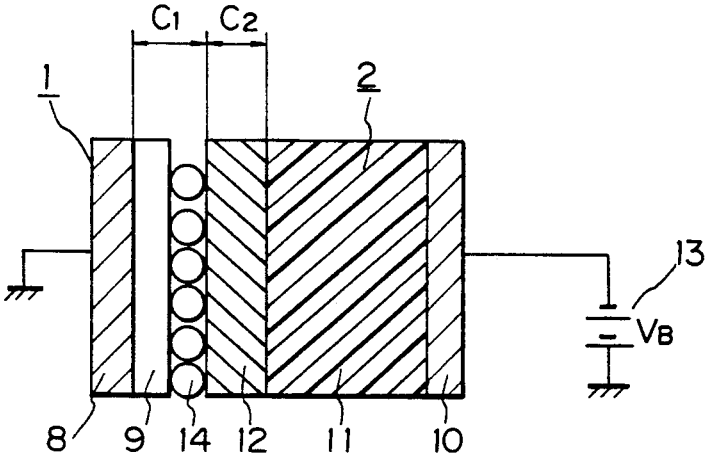
FIG. 2 is a construction view diagrammatically showing the vicinity of the developing area.

Here, the photosensitive body 1 is made by forming a photoconductive layer 9 on a base layer 8, as shown in FIG. 2. On the other hand, the developing roller 2 is made by disposing a conductive elastic body layer 11 of almost 6 mm thickness consisting of urethane rubber mixed with carbon on a conductive supporter 10, and by further disposing a high-resistance-value resistor layer 12 of almost 50 μm thickness consisting of urethane resin dispersed with a small amount of carbon, on the surface of the conductive elastic body layer 11.

It is an object of disposing the conductive elastic body layer 11 to keep uniform contact with the photosensitive body 1. On that occasion, the time constant of the conductive elastic body layer 11 can be set at a sufficiently small or even negligible value.

Figure 3A:
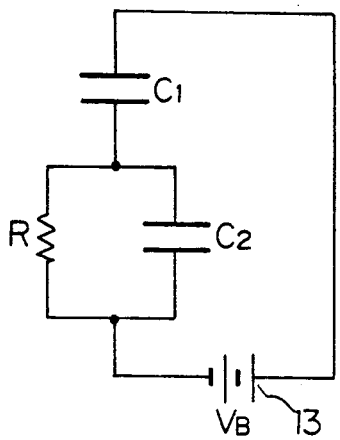
FIG. 3*a* and FIG. 3*b* are alternative circuit diagrams showing equivalent circuits of an embodiment of this invention.
Figure 3B:
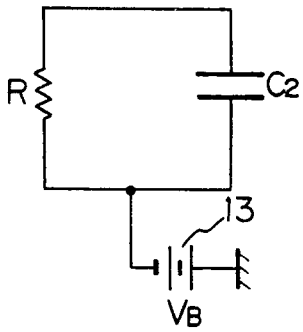

On the other hand, a developing bias power source 13 is connected to the developing roller 2 as shown in FIGS. 2 and 3, and a bias voltage VB is applied thereto. Here, the resistor layer 12 equivalently has electrostatic capacitance C2 and electric resistance R as shown in FIG. 3(*b*). The time constant $\tau_1$ of the resister layer 12 is represented by the equation: $\tau_1 = C2 \times R$. And further, the bias voltage is suitably applied to the replenishing roller 4 and the thin layer thickness regulating roller 5, etc.

In such construction, the photosensitive body 1 and the respective rollers 2, 4 and 5 are rotated in a direction shown by an arrow mark in FIG. 1, and thereby the process of developing is practiced.

At first, toner supplied onto the developing roller 2 by the replenishing roller 4 is formed in a state of thin layer having a desired thickness of toner layer by the thin layer thickness regulating roller 5. Here, the amount of supplied toner on the developing roller 2 before passing through the thin layer thickness regulating roller 5 is larger than the desired value. In this state, there is an excessive supply of the toner. Further, an opposing electric charge counterbalancing to the toner amount exists on the surface layer of the developing roller 2.

Therefore, the opposing electric charge turns out to be excessive immediately after passing through the thin layer thickness regulating roller 5.

On the other hand, since the effective bias voltage to be applied to the developing roller 2 in the process of developing is varied due to the electric potential on the roller surface caused by the amount of the roller surface electric charge, it is necessary to keep in balance the electric charge amount of thin layer of the toner entering the developing area in order to properly perform the process of developing in the developing area.

For this reason, the surplus electric charge on the developing roller 2 has to be sufficiently attenuated till entering the developing area. Here, in the embodiment of the present invention, assuming that the time period during which a point situated on the developing roller 2 enters the developing area after passing through the thin layer thickness regulating roller 5 is t2, the time constant $\tau_1$ of the resistor layer 12 is set to a value so as to satisfy the inequality:

$\tau_1 < t2$.

As mentioned heretofore, since the time constant $\tau_1$ of the resistor layer 12 is smaller than the time period t2, the surplus electric charge on the surface of the developing roller 2 is sufficiently attenuated till entering the developing area. In such a manner, the roller 2 enters the developing area in a proper state.

Consequently, a process of proper developing can be secured without being affected by the surplus electric charge. Furthermore, the above matter aims at improving its margin for constructing the developing roller 2.

Next, a developing nip is created by bringing the photosensitive body 1 and the developing roller 2 into pressed contact with each other in the developing area. Namely, the developing nip consisting of the developing roller 2 and the photosensitive body 1 is employed as the developing area. Here, assume that the time period during which a point situated on the developing roller 2 passes through the developing area is t1, and the layer on the developing roller 2 including the photosensitive body 1 has a large time constant. In such construction, the component of resistance can be neglected and therefore the layer is considered to be equivalent to the capacitance C1 as shown in FIG. 3(*a*).

In other words, as shown in FIG. 2, the electrostatic capacitance of space between the photosensitive body 1 and the developer layer 14 is C1. In this connection, FIG. 3(*b*) shows an equivalent circuit at the time and location in case that the developing roller 2 does not come in contact with the other member(s).

And further, a series circuit consisting of the capacitor Cl and a parallel circuit of the resistor R and the capacitor C2 of the resistor layer 12 is formed in the developing area. At this time, the time constant $\tau_2$ determined by the resistor layer 12 and the space between the photosensitive body 1 and the developer layer 14 is represented by the equation:

$$\tau_2=(C1+C2)\times R.$$

In the present embodiment, since the time constant $\tau_2$ is made large compared with the developing time t1 so as to satisfy the inequality: $t1<\tau_2$, it may be deemed that the resistor layer 12 is an insulator layer in the developing area. Consequently, even in case that the developing roller 2 has a resistor component consisting of the resistor layer 12, the resistor layer 12 is equivalent to the insulator in the developing area, and therefore the developing roller 2 is not affected by the variation of the environmental condition such as the temperature variation, etc., so that the intensity of the developing electric field can be stabilized in order to obtain a desired developing condition.

After developing the electrostatic latent image formed on the photosensitive body 1, the developing roller 2 is rotatably moved toward the replenishing roller side 4 and replenished with new toner. Here, paying attention to the developer on the developing roller 2, the portion on which the toner layer is peeled off using up the toner on the process of developing and the other portion with the toner layer remaining thereon mixedly exist on the developing roller 2.

When the toner is newly replenished onto the developing roller 2 by the replenishing roller 4, on the condition that the electric potential on the developing roller 2 is in a state of inequality, a difference in toner-supplying may occur and it causes an unevenness in the toner layer on same occasions. Consequently, after finishing the process of developing, the surplus electric potential on the developing roller 2 has to be sufficiently attenuated till arriving at the area of the developer replenishing member 4, in order to uniformly supply the toner onto the developing roller 2. With respect to this above point, according to the embodiment of the present invention, assuming that the time period during which the point situated on the developing roller 2 passes through the area after passing through the developing area till arriving at the area of the developer replenishing roller 4 is t3, the time constant $\tau_1$ of the resistor layer 12 is made small so as to satisfy the inequality:

$$t3>\tau_2.$$

In consequence, the surplus electric potential on the surface of the developing roller 2 is sufficiently attenuated till arriving at the developer replenishing roller 4, and thereby it may become possible to replenish the toner in such a manner as to obtain a uniform thickness of the toner layer without any inequalities.

Figure 4:
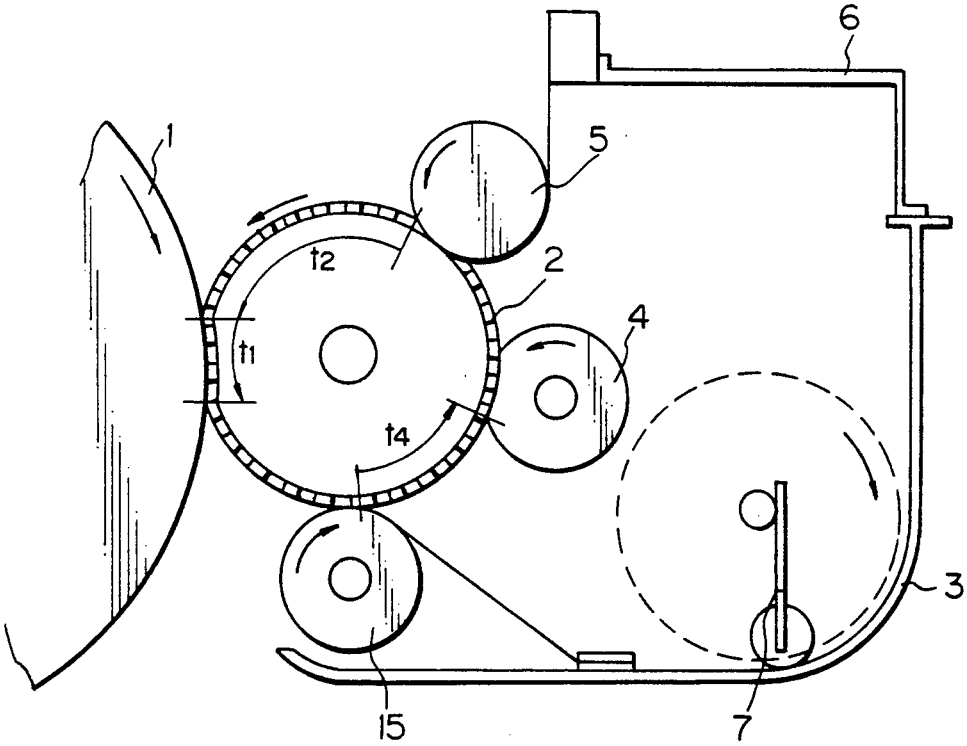
FIG. 4 is an outlined front view showing a second embodiment according to the present invention.

Secondly, the second embodiment of the present invention is described hereinafter, referring to FIG. 4. Same reference numeral is attached to the same portion as shown in the first embodiment. The second embodiment is applied to the modification of the former embodiment provided with the removing roller 15. The roller 15 is employed as a toner removing member for removing the toner (developer) remaining on the surface of the developing roller 2 after finishing the process of developing which is situated in the area after the developing process till arriving at the replenishing roller 4. And further, the bias voltage is suitably applied to the toner removing roller 15.

In relation to the developing device having such toner removing roller 15, assuming that the point situated on the developing roller 2 passes through the area after passing through the toner removing roller 15 till arriving at the toner replenishing roller 4 is t4, if the time constant $\tau_1$ of the resistor layer 12 is made small so as to satisfy the inequality: $t4>\tau_1$, the surplus electric potential on the surface of the developing roller 2 is sufficiently attenuated before arriving at the toner replenishing roller 4, so that it may become possible to replenish the toner so as to obtain the toner layer of uniform thickness without any inequality.

As shown in the embodiment described heretofore, even in case that the developing roller 2 has the resistor component consisting of the resistor layer 12 on the surface layer thereof, the relationship between the time constant $\tau_1$ of the resistor layer 12 and the processing time period t2, t3 and t4 at the respective portions is so controlled that the surface electric potential of the developing roller 2 can be stabilized at the respective portions.

Furthermore, if the time constant $\tau_2$ containing the resistor layer 12 and the combination of the photosensitive body 1 and the developer layer 14 is made larger than the developing time period t1, the resistor layer can be used as an insulator layer in the developing area.

It follows that the above-mentioned enables us to control the developing electric field.

Moreover, although the developing roller 2 is used as the developer carrying member in the embodiments of the present invention, other developer carrying member in a state of belt can be used, and the materials of the conductive elastic layer 11 and the resistor layer 12 are not limited to the above-mentioned. And further, the process of developing is not limited to the contact type process. It may be possible to perform the non-contact type process of developing. Even on this occasion, the developing device may be constructed so as to satisfy the above-mentioned relationship in the area excluding the developing area.

As mentioned heretofore, the present invention relates to a developing device of one-component developing type for developing latent image on image carrier, wherein C1 is electrostatic capacitance of space between photosensitive body and developer layer, R is electric resistance of the resistor layer, C2 is electrostatic capacitance of the resistor layer, $\tau_1$ is time constant determined by the constants; R and C2, in accordance with the following equation:

$$\tau_1=C2\times R,$$

$\tau_2$ is time constant determined by the constants: R, C1 and C2, in accordance with the following other equation:

$$\tau_2=(C1+C2)\times R,$$

t1 is a time period during which a point situated on the developer carrying member passes through a developing area determined by the developer carrying member and the photosensitive body, t2 is another time period during which the point situated on the developer carrying member passes through the developing area from the thin layer regulation member till entering the developing area, t3 is still another time period during which the point situated on the developer carrying member passes through the area after passing through the developing area till arriving at the developer replenishing member, and t4 is still another time period during which the point situated on the developer carrying member passes through the area after passing through the removing member till arriving at the developer replenishing member.

According to the description of the first invention, since the time constant $\tau_2$ determined by the resistor layer and the space between the photosensitive body and the developer layer in accordance with the equation:

$$\tau_2=(C1+C2)\times R,$$

is made longer than the time period t1 during which the point situated on the developer carrying member passes through the developing area determined by the developer carrying member and the photosensitive body, the resistor layer can be deemed to be an insulator layer in the developing area. Consequently, the intensity of the developing electric field can be stabilized in the developing area in order to set the desired developing condition. In such construction, the resistor layer itself does not need to be the insulator layer, and thereby the margin of controlling the developing electric field may be increased due to the environmental variation such as temperature, humidity, etc.

Further, the thickness of the developer layer on the developer carrying member is regulated to a desired value by the thin layer regulation member before entering the developing area. However, according to the description of the second invention, since the time constant of the resistor layer of the developer carrying member is smaller than the time period t2 during which a point on the developer carrying member passes through the area starting from the thin layer thickness regulation member till entering the developing area, it follows that the surplus electric charge on the surface of the developer carrying member is sufficiently attenuated till entering the developing area. Consequently, the electric potential on the surface of the developer carrying member becomes in a proper state of developing, and thereby the operation of developing can be performed without any variation of the effective bias.

Furthermore, when the developer is replenished onto the developer carrying member by the developer replenishing member after finishing the process of developing, a portion on which the developing process and another portion on which the developer remains mixedly exist on the surface of the developer carrying member and thereby the surface thereof can become in a state of uniform electric potential. However, according to the description of the third embodiment of this invention, since the time constant $\tau_1$ is smaller than the time period t3 from passing through the developing area till arriving at the developing replenishing member, the surplus electric potential on the surface of the developer carrying member can be sufficiently attenuated till arriving at the developer replenishing member. In consequence, the surface of the developer does not start the operation of replenishing the developer on the condition of keeping the electric carrier of the developing process after finishing the process, so that the operation of replenishing the developer can be uniformly done so as not to exert an influence upon the effective developing bias.

The above-mentioned matter can be also similarly applied to the developing device provided with the removing device for removing the developer remaining on the developer carrying member after finishing the process of developing.

According to the description of the fourth embodiment of this invention, since the time constant is smaller than the time period t4 during which a point situated on the developer carrying member passes through the area after passing through the area starting from the removing member till arriving at the developer replenishing member, the developer can be uniformly replenished.

Furthermore, as shown in the description of the fifth through ninth embodiments of this invention, the multiplication effect can be exhibited on the condition of adequately combining those embodiments.

What is claimed as new and desired to be Secured by Letter Patent of the United States is:

1. A developing device of one-component developing type for developing latent image on image carrier comprising:

a developer carrying member having resistor layer on surface layer thereof, said resistor layer of said developer carrying member having electric characteristic satisfying the following:

$$t1<\tau_2,$$

wherein,

C1 is electrostatic capacitance of space between photosensitive body and developer layer, R is electric resistance of said resistor layer, C2 is electrostatic capacitance of said resistor layer, $\tau_2$ is time constant determined by said resistor layer and said space between said photosensitive body and said developer layer, namely, by the constants; R, C1 and C2, in accordance with the following equation:

$$\tau_2=(C1+C2)\times R$$

and t1 is time period during which a point situated on said developer carrying member passes through a developing area determined by said developer carrying member and said photosensitive body, means for adjusting the electrostatic capacitance of the space between said developer-carrying member in the layer placed thereon and the moving speed thereof, such that the electrostatic capacitance of said resistance layer, the electrical resistance of said resistor layer and the moving speed of said developer carrying member are adjusted in such a manner so that said resistor layer may be insulated during the time of developing and at all other times be conductive.

2. A developing device of one-component developing type for developing latent image on image carrier comprising:

a developing carrying member having resistor layer on surface layer thereof, and a thin layer regulation member for regulating the thickness of developer disposed on said developer carrying member, said resistor layer of said developer carrying member having electric characteristic satisfying the following:

$$t2 > \tau_1$$

wherein,

R is electric resistance of said resistor layer,

C2 is electrostatic capacitance of said resistor layer, $\tau_1$ is time constant determined by the constants; R and C2, in accordance with the following equation:

$$\tau_1 = C2 \times R,$$

and t2 is time period during which a point situated on said developer carrying member in fishes to pass through said thin layer regulation member until said developer carrying member and said photosensitive body, means for adjusting the electrostatic capacitance of the space between said developer-carrying member in the layer placed thereon and the moving speed thereof, such that the electrostatic capacitance of said resistance layer, the electrical resistance of said resistor layer and the moving speed of said developer carrying member are adjusted in such a manner so that said resistor layer may be insulated during the time of developing and at all other times be conductive.

3. A developing device of one-component developing type for developing latent image on image carrier comprising:

a developer carrying member having resistor layer on surface layer thereof, and a developer replenishing member for replenishing developer onto said developer carrying member after finishing a process of developing, said resistor layer of said developer carrying member having electric characteristic satisfying the following:

$$t3 > \tau_1,$$

wherein,

R is electric resistance of said resistor layer,

C2 is electrostatic capacitance of said resistor layer, is time constant determined by the constants; R and C2, in accordance with the following equation:

$$\tau_1 = C2 \times R,$$

and t3 is time period during which, after a point situated on said developer carrying member passes through a developing area determined by said developer carrying member and said photosensitive body, said point moves till arriving at said developer replenishing member, means for adjusting the electrostatic capacitance of the space between said developer-carrying member in the layer placed thereon and the moving speed thereof, such that the electrostatic capacitance of said resistance layer, the electrical resistance of said resistor layer and the moving speed of said developer carrying member are adjusted in such a manner so that said resistor layer may be insulated during the time of developing and at all other times be conductive.

4. A developing device of one-component developing type for developing latent image on image carrier comprising:

a developer carrying member having resistor layer ion surface layer thereof.

a removing member for removing developer remaining on said developer carrying member after finishing a process of developing carrying member, and a developer replenishing member for replenishing developer onto said developer carrying member from which said developer remaining thereon is removed, said resistor layer of said developer carrying member having electric characteristic satisfying the following:

$$t_4 > \tau_1,$$

wherein,

R is electric resistance of said resistor layer,

C2 is electrostatic capacitance of said resistor layer, $\tau_1$ is time constant determined by the constants; R and C2, in accordance with the following equation:

$$\tau_1 = C2 \times R,$$

$\tau_4$ is time period during which a point situated on said developer carrying member passes through the area after passing through said removing member until arriving at said developer replenishing member, means for adjusting the electrostatic capacitance of the space between said developer-carrying member in the layer placed thereon and the moving speed thereof, such that the electrostatic capacitance of said resistance layer, the electrical resistance of said resistor layer and the moving speed of said developer carrying member are adjusted in such a manner so that said resistor layer may be insulated during the time of developing and at all other times be conductive.

5. A developing device of one-component developing type for developing latent image on image carrier comprising:

a developer carrying member having resistor layer on surface layer thereof, and a thin layer regulation member for regulating the thickness of developer disposed on said developer carrying member, said resistor layer of said developer carrying member having electric characteristic satisfying the following:

$$t1 < \tau_2$$

and $$t2 < \tau_1$$

wherein,

Cl is electrostatic capacitance of space between photosensitive body and developer layer, R is electric resistance of said resistor layer, C2 is electrostatic capacitance of said resistor layer, $\tau_1$ is time constant determined by the constants; R and C2, in accordance with the following equation:

$$\tau_i = C2 \times R,$$

$\tau_2$ is time constant determined by said resistor layer and said space between said photosensitive body and said developer layer, namely, by the constants; R, C1 and C2, in accordance with the following other equation:

$$\tau_2 = (C1 + C2) \times R,$$

t1 is time period during which a point situated on said developer carrying member passes through a developing area determined by said developer carrying member and said photosensitive body, t2 is another time period during which said point situated on said developer carrying member passes through the area from said thin layer regulation member till entering said developing area, means for adjusting the electrostatic capacitance of the space between said developer-carrying member in the layer placed thereon and the moving speed thereof, such that the electrostatic capacitance of said resistance layer, the electrical resistance of said resistor layer and the moving speed of said developer carrying member are adjusted in such a manner so that said resistor layer may be insulated during the time of developing and at all other times be conductive.

6. A developing device of one-component developing type for developing latent image on image carrier comprising:

a developer carrying member having resistor layer on surface layer thereof, and a developer replenishing member for replenishing developer onto said developer carrying member after finishing a process of developing, said resistor layer of said developer carrying member having electric characteristic satisfying the following:

$$t1 < \tau_2$$

and $$t3 > \tau_1$$

wherein, C1 is electrostatic capacitance of space between photosensitive body and developer layer, R is electric resistance of said resistor layer, C2 is electrostatic capacitance of said resistor layer, $\tau_1$ is time constant determined by the constants; R and C2, in accordance with the following equation:

$$\tau_1 = C2 \times R,$$

$\tau_2$ is time constant determined by said resistor layer and said space between said photosensitive body and said developer layer, namely, by the constants; R, C1 and C2, in accordance with the following other equation:

$$\tau_2 = (C1 + C2) \times R,$$

t1 is time period during which a point situated on said developer carrying member passes through a developing area determined by said developer carrying member and said photosensitive body, and t3 is time period during which said point situated on said developer carrying member passes through the area after passing through said developing area till arriving at said developer replenishing member, means for adjusting the electrostatic capacitance of the space between said developer-carrying member in the layer placed thereon and the moving speed thereof, such that the electrostatic capacitance of said resistance layer, the electrical resistance of said resistor layer and the moving speed of said developer carrying member are adjusted in such a manner so that said resistor layer may be insulated during and time of developing and at all other times be conductive.

7. A developing device of one-component developing type for developing latent image on image carrier comprising:

a developer carrying member having resistor layer on surface layer thereof.

a developer replenishing member for replenishing developer onto said developer carrying member after finishing a process of developing, and a thin layer regulation member for regulating the thickness of developer disposed on said developer carrying member, said resistor layer of said developer carrying member having electric characteristic satisfying the following:

$$t1 < \tau_2$$

$$t2 > \tau_1$$

and $$t3 > \tau_1$$

wherein,

C1 is electrostatic capacitance of space between photosensitive body and developer layer, R is electric resistance of said resistor layer, C2 is electrostatic capacitance of said resistor layer, $\tau_1$ is time constant determined by the constants; R and C2, in accordance with the following equation:

$$\tau_1 = C2 \times R,$$

$\tau_2$ is another time constant determined by said resistor layer and said space between said photosensitive body and said developer layer, namely, by the constants, R, C1 and C2, in accordance with the following other equation:

$$\tau_2 = (C1 + C2) \times R,$$

t1 is time period during which a point situated on said developer carrying member passes through a developing area determined by said developer carrying member and said photosensitive body, t2 is another time period during which said point situated on said developer carrying member passes through the area from said thin layer regulation-member till entering said developing area, and t3 is still another time period after passing through said developing area till arriving at said developer replenishing member, means for adjusting the electrostatic capacitance of the space between said developer-carrying member in the layer placed thereon and the moving speed thereof, such that the electrostatic capacitance of said resistance layer, the electrical resistance of said resistor layer and the moving speed of said developer carrying member are adjusted in such a manner so that said resistor layer may be insulated during the time of developing and at all other times be conductive.

8. A developing device of one-component developing type for developing latent image on image carrier comprising:

a developer carrying member having resistor layer on surface layer thereof.

a removing member for removing developer remaining on said developer carrying member after finishing a process of developing, and a developer replenishing member for replenishing developer onto said developer carrying member from which said remaining developer is removed, said resistor layer of said developer carrying member having electric characteristic satisfying the following:

$$t1 < \tau_2$$

and $$t4 > \tau_1$$

wherein,

C1 is electrostatic capacitance of space between photosensitive body and developer layer, R is electric resistance of said resistor, C2 is electrostatic capacitance of said resistor layer, $\tau_1$ is time constant determined by the constants; R and C2, in accordance with the following equation:

$$\tau_1 = C2 \times R,$$

$\tau_2$ is time constant determined by said resistor layer and said space between said photosensitive body and said developer layer, namely, by the constants; R, C1 and C2, in accordance with the following other equation:

$$\tau_2 = (C1 + C2) \times R,$$

t1 is time period during which a point situated on said developer carrying member passes through a developing area determined by said developer carrying member and said photosensitive body, and t4 is time period during which said point situated on said developer carrying member passes through the area after passing through said removing member till arriving at said developer replenishing member, means for adjusting the electrostatic capacitance of the space between said developer-carrying member in the layer placed thereon and the moving speed thereof, such that the electrostatic capacitance of said resistance layer, the electrical resistance of said resistor layer and the moving speed of said developer carrying member are adjusted in such a manner so that said resistor layer may be insulated during the time of developing and at all other times be conductive.

9. A developing device of one-component developing type for developing latent image on image carrier comprising:

a developer carrying member having resistor layer on surface layer thereof, a removing member for removing developer remaining on said developer carrying member after finishing a process for developing, a developer replenishing member for replenishing developer onto said developer carrying member for which said developer remaining thereon is removed, and a thin layer regulation member for regulating the thickness of developer disposed on said developer carrying member, said resistor layer of said developer carrying member having electric characteristic satisfying the following:

$$t1 < \tau_2$$

$$t2 > \tau_1$$

and $$t4 > \tau_1$$

wherein,

C1 is electrostatic capacitance of space between photosensitive body and developer layer, R is electric resistance of said resistor layer, C2 is electrostatic capacitance of said resistor layer, $\tau_1$ is time constant determined by the constants; R and C2, in accordance with the following equation:

$$\tau_1 = C2 \times R,$$

$\tau_2$ is another time constant determined by said resistor layer and said space between said photosensitive body and said developer layer, namely, by the constants; R, C1 and C2, in accordance with the following other equation:

$$\tau_2 = (C1 + C2) \times R,$$

t1 is time period during which a point situated on said developer carrying member passes through a developing area, t2 is another time period during which said point finishes to pass through said thin layer regulation member and enters the developing area determined by said developer carrying member and a photosensitive body, and t4 is still another time period during which said point finishes to pass through the area of said removing member and arrives at said developer replenishing member, means for adjusting the electrostatic capacitance of the space between said developer-carrying member in the layer placed thereon and the moving speed thereof, such that the electrostatic capacitance of said resistance layer, the electrical resistance of said resistor layer and the moving speed of said developer carrying member are adjusted in such a manner so that said resistor layer may be insulated during the time of developing and at all other times be conductive.

10. A developing device of a one-component developing type for developing latent images on an image carrier comprising:

a developer-carrying member having a resistor layer formed on one surface thereof;

wherein said resistor layer at the time of developing has conditions established in such a manner so that said resistor layer is an insulator and further at a respective time, before the controlling of adhesion of a toner to said resistor layer; and/or before controlling toner removal from said resistor layer, and/or before supplying said toner to a developing area said resistor layer is conductive;

means for supplying an electric charge to the surface of said developing-carrying member and to supply and control the amount of the electric charge on the developing layer, such that said electric charges are balanced with each other when said resistor layer is in a conductive state; and further means for adjusting the electrostatic capacitance of the space between said developer-carrying member and the layer placed thereon and the moving speed thereof, such that the electrostatic capacitance of said resistance layer, the electrical resistance of said resistor layer, and the moving speed of said developer-carrying member and adjusted in such a manner so that said resistor layer may be insulated during the time of developing and at all other times be conductive.

* * * * *